US011514798B2

(12) United States Patent
Gonzalez et al.

(10) Patent No.: US 11,514,798 B2
(45) Date of Patent: Nov. 29, 2022

(54) UAV RISK-BASED ROUTE PLANNING SYSTEM

(71) Applicant: The Boeing Company, Chicago, IL (US)

(72) Inventors: Garoe Gonzalez, Frankfurt (DE); Anna-Lisa Mautes, Darmstadt (DE); Hugo Eduardo Teomitzi, Darmstadt (DE); Michael Christian Büddefeld, Dreieich (DE)

(73) Assignee: The Boeing Company, Chicago, IL (US)

( * ) Notice: Subject to any disclaimer, the term of this patent is extended or adjusted under 35 U.S.C. 154(b) by 41 days.

(21) Appl. No.: 16/863,225

(22) Filed: Apr. 30, 2020

(65) Prior Publication Data

US 2021/0343158 A1 Nov. 4, 2021

(51) Int. Cl.

| | |
|---|---|
| ***G08G 5/00*** | (2006.01) |
| ***G08G 5/04*** | (2006.01) |
| ***G08G 5/06*** | (2006.01) |

(52) U.S. Cl.

CPC ..... *G08G 5/0034* (2013.01); *G08G 5/0021* (2013.01); *G08G 5/0065* (2013.01); *G08G 5/0069* (2013.01); *G08G 5/045* (2013.01); *G08G 5/065* (2013.01)

(58) Field of Classification Search

CPC .. G08G 5/0034; G08G 5/0021; G08G 5/0065; G08G 5/0069; G08G 5/045; G08G 5/065

USPC ..... 701/528

See application file for complete search history.

(56) References Cited

U.S. PATENT DOCUMENTS

2011/0234425 A1* 9/2011 Germanetti ..... G08G 5/045 340/945

2021/0172740 A1* 6/2021 Cajias ..... G08G 5/0034

OTHER PUBLICATIONS

Sara Mahmoud et al., "Integrating UAVs into the Cloud Using the Concept of the Web of Things", Hindawi Publishing Corporation, Journal of Robotics, vol. 2015, Article ID 631420, 10 pages, https://dx.doi.org/10.1155/2015/631420.

* cited by examiner

*Primary Examiner* — Isaac G Smith

(74) *Attorney, Agent, or Firm* — Quinn IP Law

(57) ABSTRACT

A system and method for conducting preflight planning for autonomous flight missions of unmanned aerial vehicles (UAVs). The system includes use of a controller to conduct quantitative risk assessments of available digital data to predict low risk flight routes based on estimated flight risk profiles. The flight risk profiles may be based upon flight safety-critical information, including real time regulatory, airspace, obstacle, and infrastructure data sets. Among other data sets, the flight risk profiles may also account for current weather, current population and traffic data, and aircraft operational data specific to the UAV involved. Each risk assessment can generate a flight risk profile dependent on proposed times of travel, from which a low risk route may be predicted for any impending autonomous aircraft flight. Such risk assessments may enhance chances of expeditious regulatory acceptance of flight plans for such predetermined flight routes.

20 Claims, 4 Drawing Sheets

UAV RISK-BASED ROUTE PLANNING SYSTEM

FIELD

The present disclosure relates generally to automated systems and methods of using safety-critical information to manage flights of unmanned aerial vehicles (UAVs), and more specifically to a preflight planning system for making quantitative assessments of potential UAV flight route data to predict flight routes having low relative risks.

BACKGROUND

Unmanned aerial vehicles (UAVs) are commonly used by hobbyists, but are also used by government organizations and businesses for a variety of utilitarian purposes. Specialized UAV missions of the latter typically require specific payloads to be conveyed by UAVs to various locations. Unfortunately, UAV operators have endured relatively limited resources for assessing operational risks of their flight routes, which are generally conducted at relatively low flight altitudes, and thus are burdened with greater restrictions than those normally encountered at higher flight routes used by manned aircraft. Beyond that, currently available resources only partially address substantive risks of any particular UAV mission, with UAV operators often relying primarily on restricted air space regulations and available data for avoiding ground obstacles.

In the meantime, there are no known comprehensive solutions for determining overall operational flight risks for UAVs, which among other aspects include considerations of expected weather, flight regulations/restrictions, infrastructure, and specific limitations of any particular UAV, etc. Thus, UAV operators have generally had to rely on multiple software platforms for preflight planning of any given flight. Such platforms have, for example, included "AirMap" for procuring digital authorizations for UAV flight in controlled airspace, "UAV Forecast" for checking weather, and "Sun Surveyor" for checking amounts of daylight expected along prospective flight paths. In addition, current solutions for preflight planning tend to provide only qualitative methods of risk analysis, even though considerable aeronautical data, including airspace rules, weather, and infrastructure restrictions, are digitally available.

SUMMARY

In accordance with one aspect of the present disclosure, a preflight planning system for quantitatively assessing and minimizing risks associated with potential UAV flight routes includes a controller. The controller is configured to receive and process a quantity of data for an aircraft type, as well as to receive and process both static and dynamic information related to various aspects of flight safety. The controller is further configured to estimate a flight risk profile for a future time period through a planned flight environment, and based on the flight risk profile, the controller predicts a flight route determined to have a low relative risk.

In accordance with another aspect of the present disclosure, a controller incorporates a preflight planning system for quantitatively assessing and minimizing risks associated with potential UAV flight routes. The preflight planning system includes a capacity to receive and process a quantity of data for an aircraft type, as well as a capacity to receive and process both static and dynamic information related to aspects of flight safety. The system is further configured to estimate a flight risk profile for a future time period through a planned flight environment, and, based on the flight risk profile, to predict a flight route determined to have a low relative risk.

In accordance with yet another aspect of the present disclosure, a method of preflight planning potential UAV flight routes quantitatively assesses and minimizes flight risks. The method includes steps of securing a controller, and configuring the controller to receive and process a quantity of data for an aircraft type, and to receive and process both static and dynamic information related to aspects of flight safety. Based on the data and information received, the method further includes steps of estimating at least one flight risk profile for a future time period through a planned flight environment, and predicting a flight route determined to have a low relative risk.

The features, functions, and advantages disclosed herein can be achieved independently in various examples or may be combined in yet other examples, the details of which may be better appreciated with reference to the following description and drawings.

It should be understood that disclosed examples are illustrated only schematically. In certain instances, details which are not necessary for understanding of disclosed systems and methods have been omitted. It should be further understood that the following detailed description is merely exemplary, and not intended to be limiting in its applications or methods. As such, the disclosure may be implemented in numerous other examples, and within various systems and environments neither shown nor described herein.

DETAILED DESCRIPTION

The following detailed description is intended to provide both systems and methods for carrying out the disclosure. Actual scope of the disclosure is defined by the appended claims.

Preflight considerations, particularly for low altitude UAV or drone flights may involve conducting flying missions around ground obstacles and other environmental infrastructure, for example high-voltage transmission lines in order to conduct wind turbine inspections, or to fly grid patterns over a construction site to obtain photographic data. Other missions, for example, may involve solar plant inspections requiring thermal imagery, and can only be performed by aircraft having specialized sensors onboard. Therefore, preflight planning for UAVs must often be specific to the particular drone type, and will involve missions having specific flight trajectories.

Figure 1:
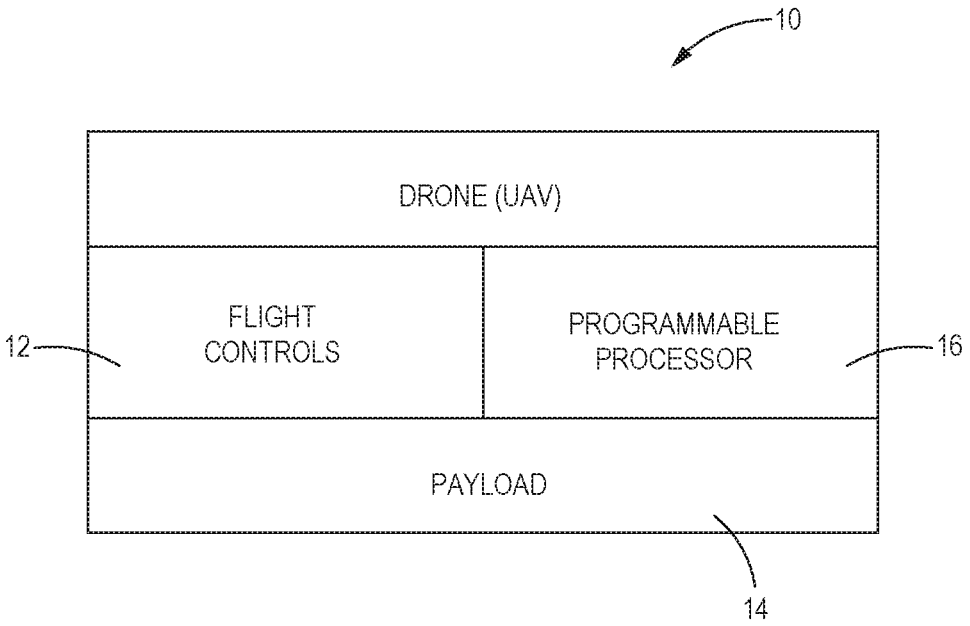
FIG. 1 is a schematic representation, only, of an unmanned aerial vehicle, a.k.a. drone, that may be used in accordance with the present disclosure.
Figure 2:
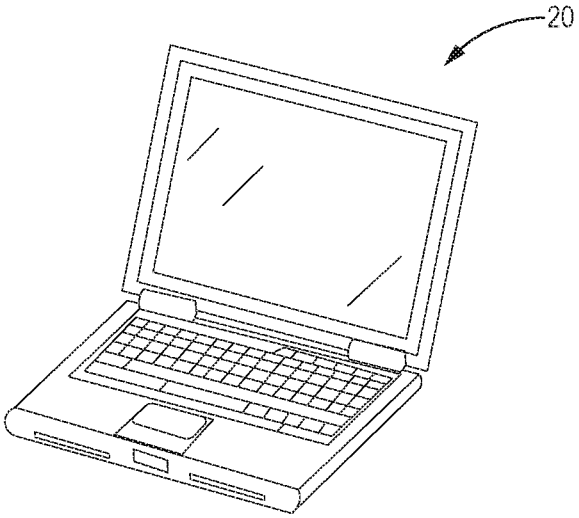
FIG. 2 is a view of an exemplary preflight planning controller, a.k.a. computer, as envisioned for use in accordance with the present disclosure.

Referring initially to FIG. 1, an unmanned aerial vehicle (UAV) or drone 10, capable of conducting autonomous flight missions, is depicted schematically. Among other features and apparatus, the drone 10 includes flight controls 12, a payload 14, and a programmable processor 16 for conducting missions having specific flight trajectories (not shown). In FIG. 2, a controller 20 may be used to conduct preflight planning for future autonomous flight missions of the drone 10. The controller 20 may be a laptop computer, as shown, or may be any other type of computer, such as a desktop, tablet, or even a smartphone that includes processor and memory components (not shown), which are well known to those skilled in the art.

The controller 20 may employ "computer readable medium" (not shown), which, as used herein, refers to any non-transitory medium or combination of media that provides instructions to the processor for execution. For purposes of this disclosure, computer-readable media include any electronically readable medium.

The drone 10 may have any number of shapes and forms. For example, a multirotor drone, such as for example a "DJI Mavic Pro 2", is recognized for having great agility over short missions. On the other hand, a fixed-wing drone, such as for example a "senseFly eBee", is associated with endurance over longer missions.

Figure 3:
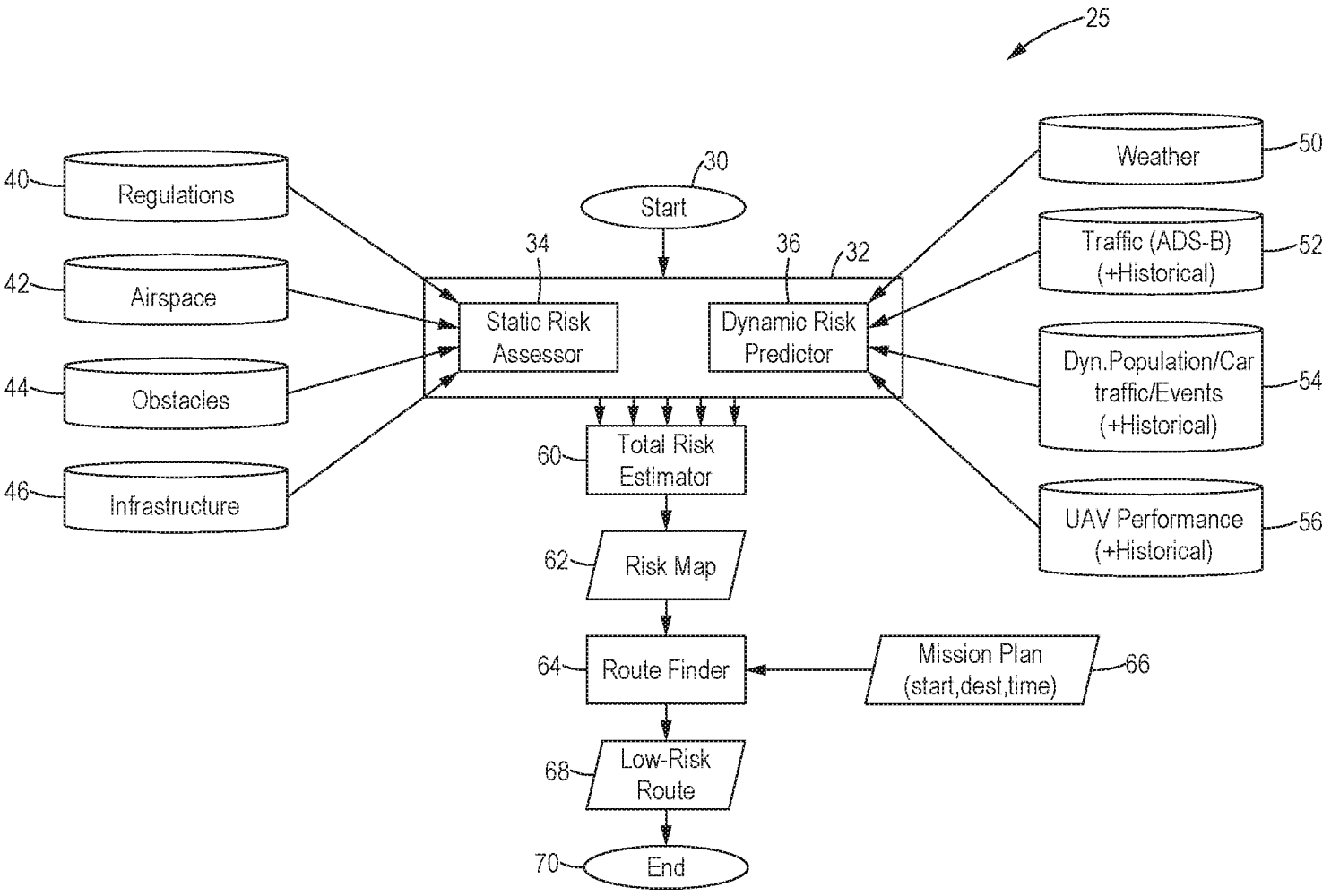
FIG. 3 is a schematic preflight planning flowchart depicting exemplary sets of data that may be utilized in accordance with the present disclosure.

Referring now to FIG. 3, a schematic flowchart of an automated and digitized controller-based preflight planning system 25 depicts exemplary static and dynamic sets of data. The flowchart, including starting and end points 30 and 70, respectively, reveals that the preflight planning system 25 employs a combined static and dynamic risk assessor 32, which contains a static risk estimator 34, and a dynamic risk predictor 36.

The static risk assessor 34 is a module having a capability of assessing various data sets related to static risk functions, including Regulations 40, Airspace 42, Obstacles 44, and Infrastructure 46. The data set of Regulations 40 would ideally include regulations relating to intended operation of UAVs within specific regulated airspace, and would include, for example, Part 107 of the Federal Regulations for UAVs operating within US airspace. Other countries have regulations relevant to particular drone missions operating within their respective airspaces.

The data set of Airspace 42 may include maps of known flight routes, such as may be available for UAV flights, including, for example, appropriate E-class airspace commonly used for low altitude UAV missions. The data set of Airspace 42 may also include surveillance technology, such as that provided by certain recently available protocols, including Automatic Dependent Surveillance-Broadcast (ADS-B), which allows receipt of signals from other aircraft within a defined airspace to provide situational awareness and collision avoidance.

The data set of the Obstacles 44 may offer the capability for avoidance of buildings, high tension wires, etc., while the data set of the Infrastructure 46 may contain information for avoidance of restricted airspace, including military installations and/or other restricted private properties situated along any potential mission routes.

The described data sets presented herein are only exemplary. Thus, although only the static data sets 40, 42, 44, and 46 have been specifically identified herein, other static data sets may be included as well.

The dynamic risk predictor 36 is a module having a capability of assessing various data sets that relate to dynamic flight risk functions, including Weather 50, Traffic (including historical) 52, Dynamic Population and Vehicular Traffic 54, and UAV Performance 56.

The data set of Weather 50 may be obtained from a variety of available sources, including the Digital Forecast Services Branch of the National Weather Service. The data set of Traffic 52 may be obtained from various real-time air traffic information sources including FlightAware and Flight Tracker, for example. The data set of Dynamic Population and Vehicular Traffic 54 may be obtained from well-known sources, including Google Maps, while the data set of UAV Performance 56 may be digitally available directly from the UAV manufacturer. On the other hand, some of the data set of UAV Performance 56, for example parameters including battery degradation and/or engine power, may be derived historically from previous flights of the UAV, without involvement of the manufacturer.

Once the preflight planning system 25 has analyzed the respective data sets via the Static Risk Assessor 34 and the Dynamic Risk Predictor 36, a Total Risk Estimator 60 may then generate a flight risk profile 62, a.k.a. a flight risk map, which will be explained later in reference to FIGS. 4-7. The flight risk profile 62 may then enable a Route Finder 64, which, when supplied with data from a Mission Plan 66, can enable the prediction of a Low-Risk Route 68. The Mission Plan 66, for this purpose, may include mission-specific information, including start time, destination, an estimate of travel time, along with specific waypoints of interest, if any, during the mission.

Figure 4:
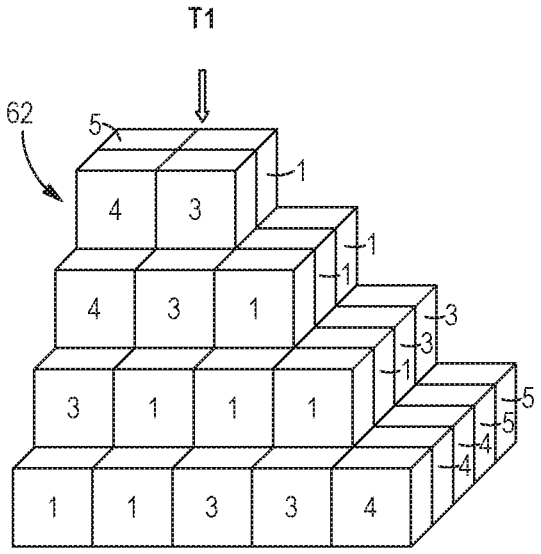
FIG. 4 is a perspective view of a time-sensitive three-dimensional flight risk profile of a UAV flight environment in accordance with the present disclosure.
Figure 5:
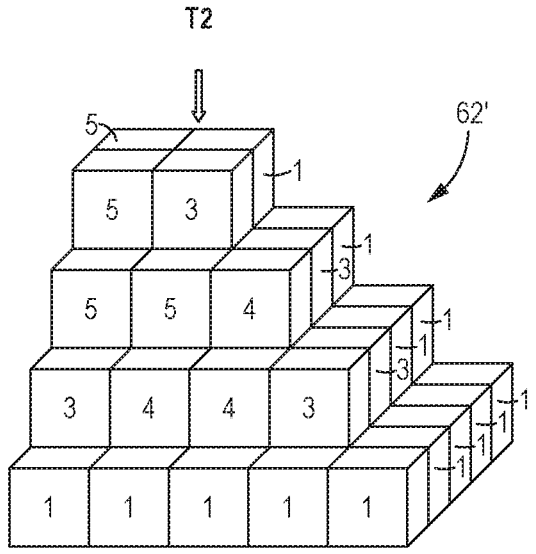
FIG. 5 is a perspective view of another time-sensitive three-dimensional flight risk profile of a UAV flight environment in accordance with the present disclosure.

Referring now to FIGS. 4 and 5, the flight risk profile 62 may be time sensitive; i.e., capable of producing different risk results for different times within an identical hypothetical flight environment. Thus, FIG. 4 is an example of a flight risk profile 62 for a first future time period T1 of potential travel, while FIG. 5 displays a flight risk profile 62' for a second future time period T2 of potential travel through the same flight environment.

The hypothetical flight environment is identical for FIGS. 4 and 5, although the risk levels are reflected schematically within multiple contiguous cubes of airspace. Each cube reflects a numeral, which provides a rating of its risk level. The numerals are shown as 1 through 5, with, along a gradient of 1, 2, 3, 4, and 5, the numeral 1 representing a lowest risk, and the numeral 5 representing a highest risk. For the first future time period T1, it will be noted that the highest risk cubes are in different locations than those within the second future time period T2. Thus, to the extent that preflight planning is time-sensitive, different low-risk flight routes or trajectories will be indicated throughout the different cubes at the different times. The preflight planning system 25, as a tool, is envisioned to effectively identify a flight trajectory having a lowest relative risk, although the specific trajectory will be a function of any previously selected risk parameters.

Figure 6:
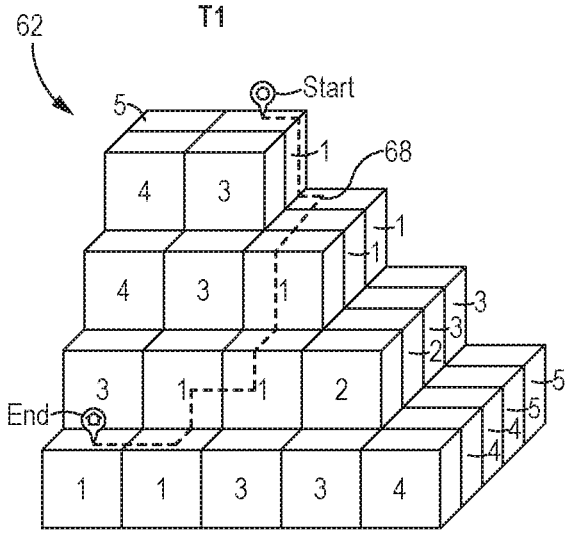
FIG. 6 is a perspective view of a low risk flight path within the flight risk profile of FIG. 4.
Figure 7:
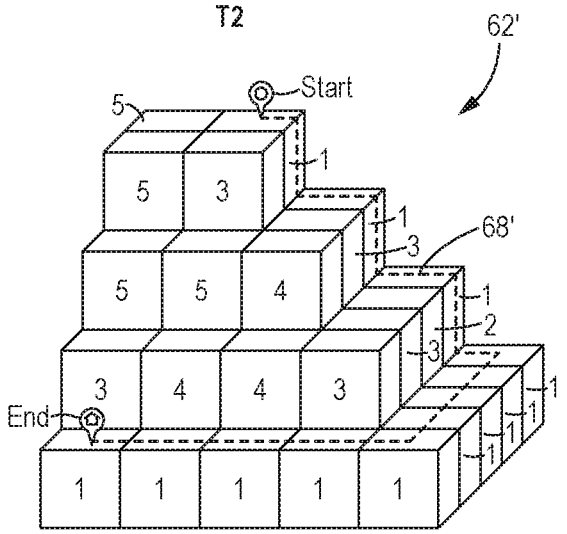
FIG. 7 is a perspective view of another low risk flight path within the flight risk profile of FIG. 5.

Referring now to FIGS. 6 and 7, the flight risk profiles 62 and 62' of FIGS. 4 and 5 are replicated, but include low risk flight routes 68 and 68', shown superimposed onto the respective flight risk profiles. The size of each three-dimensional risk cube, as schematically shown, may be arbitrary. For example, within the airspace of one potential UAV mission, the actual dimension of the cubes may be 10×10×

10 meters. The aggregate of the cubes represents the potential flight "airspace" within the hypothetical environment of an intended mission.

In FIGS. 6 and 7, although the respective low risk flight routes 68 and 68' are shown to pass only through cubes marked with 1's, there may be situations in which the flight routes could pass through at least some of the cubes marked with 2's, assuming relatively safe passage can be assured, for example. Thus, the preflight planning system 25 may be designed to be somewhat flexible, depending on mission parameters and specifics of the terrain to be overflown.

Anticipated algorithms for the preflight planning system 25 may utilize the above-described data sets 40, 42, 4, 46, 50, 52, 54, and 56, in order to predict levels of risk for each cube within the flight risk profiles 62, 62'. Ideally, risk levels will be determined based upon mathematical models that calculate relative risks based upon practical scenarios (for example: risk=number of fatalities per 100,000 flight hours). For numbers exceeding certain thresholds, the relative risks would be deemed high, meaning that affected cubes would be rated 4's or 5's, for example. Upon calculating and assessing all risk factors for a particular operational environment, the preflight planning system 25 will develop appropriate start and end points (FIGS. 6 and 7), to identify low risk passages for takeoff, flight route, and landing. The preflight planning system 25 will thus determine safe passage through the three-dimensional flight risk profile 62 at T1, or flight risk profile 62' at T2, from the start point 30 (FIG. 3) to the end point 70 (FIG. 3). As such, the preflight planning system 25 can develop a flight route 68, 68' through risk cubes reflecting lowest relative risks for the particular future time period, T1 or T2.

Figure 8:
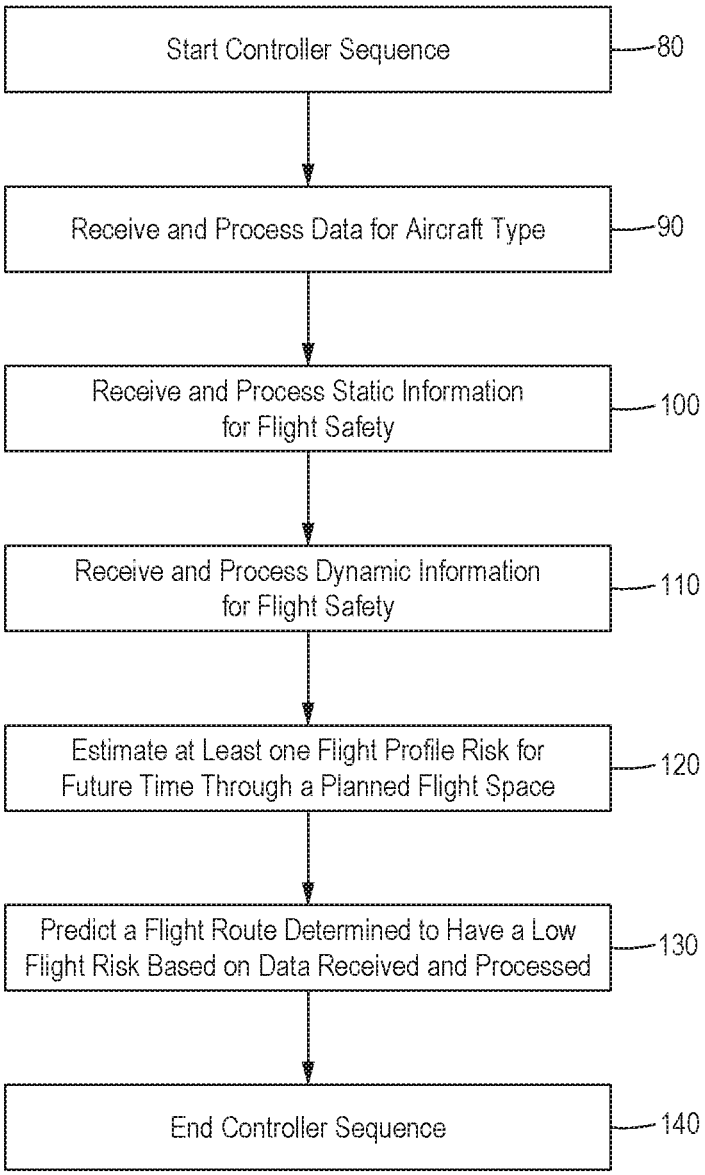
FIG. 8 is a flowchart illustrating a sequence of steps that may be conducted by a controller for estimating data and predicting a flight route through a particular flight environment.

FIG. 8 depicts a method of operating the preflight planning system 25 to achieve a predicted flight route having a low risk. Thus, the controller 20 is employed to start a digital sequence at block 80. The controller receives and processes data for the particular UAV aircraft type at block 90. The controller then receives and processes static and dynamic information for flight safety at blocks 100 and 110, respectively. The Total Risk Estimator 60 may then estimate at least one flight risk profile for a future time through a planned flight space at block 120. Finally, at block 130 the Route Finder 64 predicts a flight route, e.g. 68, 68', determined to have a low risk based upon data received and processed, and the controller 20 ends the sequence at block 140.

While the foregoing detailed description has been provided with respect to certain specific examples, it is to be understood that the scope of the disclosure is not limited to such examples, as all examples herein are provided simply for enablement and best mode purposes. Thus, breadth and spirit of the present disclosure may be deemed broader than the specific examples disclosed and encompassed within the claims appended hereto. Moreover, while some features are described in conjunction with certain specific examples, these features are not limited to use with only the embodiment in which they are described. Instead, they may be used together with or separate from, other disclosed features, and in conjunction with alternate examples.

Clause 1. A preflight planning system for quantitatively assessing and minimizing risks associated with potential unmanned aerial vehicle (UAV) flight routes, the system comprising:

a controller configured to:

receive and process a quantity of data for an aircraft type;

receive and process static information related to aspects of flight safety; and receive and process dynamic information related to aspects of flight safety;

wherein the controller is configured to estimate a flight risk profile for a future time period through a planned flight space, and based thereon, to predict a flight route determined to have a low relative risk.

Clause 2. The preflight planning system of clause 1, wherein a static risk assessor analyzes data sets for a) regulations, b) airspace, c) ground obstacles, and d) flight infrastructure.

Clause 3. The preflight planning system of clause 1, wherein a dynamic risk predictor analyzes data sets for a) weather, b) air traffic, c) population and vehicular traffic, and UAV performance.

Clause 4. The preflight planning system of clause 2, wherein the data sets comprise static information used to estimate a three-dimensional flight risk profile.

Clause 5. The preflight planning system of clause 3, wherein the data sets comprise dynamic information used to estimate a three-dimensional flight risk profile.

Clause 6. The preflight planning system of any one of clauses 1-5, wherein a first flight risk profile for one future time period is associated with a specific UAV type.

Clause 7. The preflight planning system of any one of clauses 1-6, wherein a second flight risk profile for a second future time period is distinct from the first flight risk profile.

Clause 8. The preflight planning system of clause 6, wherein the first flight risk profile for the one future time period provides at least one predicted low risk flight route.

Clause 9. The preflight planning system of clause 7, wherein the second flight risk profile for the second future time period provides at least one predicted low risk flight route.

Clause 10. The preflight planning system of any one of clauses 1-9, wherein the controller includes a total risk estimator configured to generate the flight risk profile for the future time period based upon the static information and the dynamic information.

Clause 11. The preflight planning system of any one of clauses 1-10, wherein the controller includes a route finder configured to predict the low relative risk flight route within a flight risk profile for a future time period.

Clause 12. The preflight planning system of clauses 11, wherein the route finder is configured to predict the low risk flight route for the future time period based upon the aircraft type.

Clause 13. The preflight planning system of any one of clauses 11 or 12, wherein the route finder predicts the low risk flight route based upon the flight mission plan.

Clause 14. A controller, comprising:

a preflight planning system for quantitatively assessing and minimizing risks associated with potential UAV flight routes, the system including:

a capacity to receive and process a quantity of data for an aircraft type;

a capacity to receive and process static information related to aspects of flight safety; and a capacity to receive and process dynamic information related to aspects of flight safety;

wherein the system is configured to estimate a flight risk profile for a future time period through a planned flight space, and to, based thereon, predict a flight route determined to have a low relative risk.

Clause 15. The controller of clause 14, wherein a static risk assessor analyzes data sets for a) regulations, b) airspace, c) ground obstacles, and d) flight infrastructure.

Clause 16. The controller of clause 14, wherein a dynamic risk predictor analyzes data sets for a) weather, b) air traffic, c) population and vehicular traffic, and UAV performance.

Clause 17. The controller of clause 15, wherein the data sets comprise static information used to estimate a three-dimensional flight risk profile.

Clause 18. The controller of clause 16, wherein the data sets comprise dynamic information used to estimate a three-dimensional flight risk profile.

Clause 19. A method of preflight planning potential UAV flight routes in a manner that quantitatively assesses and minimizes risks; the method comprising steps of:

securing a controller, and configuring the controller to:

receive and process a quantity of data for an aircraft type;

receive and process static information related to aspects of flight safety;

receive and process dynamic information related to aspects of flight safety;

estimate at least one flight risk profile for a future time period through a planned flight space; and predict a flight route determined to have a low relative risk, based on data received and processed.

Clause 20. The method of clause 19, further comprising:

using the controller to generate a three-dimensional flight risk profile, and to provide at least the one estimated low risk flight route based on the flight risk profile.

What is claimed is:

1. A preflight planning system for quantitatively assessing and minimizing risks associated with potential unmanned aerial vehicle (UAV) flight routes, the system comprising:

a controller configured to:

receive data related to an aircraft type of the UAV, wherein the data related to the aircraft type includes engine power data of the UAV, and the engine power data is indicative of an engine power of the UAV;

receive static information related to aspects of flight safety;

receive dynamic information related to aspects of the flight safety;

generate a flight risk profile using the static information and a plurality of risk levels of airspace by assigning a numeral to each three-dimensional cubes that are arranged in stacks relative to each other, and each of the three-dimensional cubes represent areas of airspace, wherein the numeral assigned to each of the three-dimensional cubes indicate high-risk levels, moderate-risk levels, and low-risk levels based on the static information and the dynamic information at a future time period;

analyze the risk levels of airspace using each numeral assigned to the respective three-dimensional cubes to determine a flight route that has a low-risk;

select the three-dimensional cubes, being the low-risk, as the flight route based on the flight risk profile; and operate the UAV to implement the selected flight route.

2. The preflight planning system of claim 1, wherein the static information comprises data sets for a) regulations, b) airspace, c) ground obstacles, and d) infrastructure.

3. The preflight planning system of claim 1, wherein the dynamic information comprises data sets for a) weather, b) air traffic, c) vehicular traffic, and d) UAV performance.

4. The preflight planning system of claim 2, wherein the data sets comprise static information used to generate the risk levels of airspace of the flight risk profile.

5. The preflight planning system of claim 3, wherein the data sets comprise dynamic information used to generate the risk levels of airspace of the flight risk profile.

6. The preflight planning system of claim 1, wherein the flight risk profile is a first flight risk profile used by a first type of UAV type.

7. The preflight planning system of claim 6, wherein the controller is configured to generate a second flight risk profile that is distinct from the first flight risk profile.

8. The preflight planning system of claim 6, wherein the first flight risk profile includes at least one flight route.

9. The preflight planning system of claim 7, wherein the second flight risk profile includes at least one flight route.

10. The preflight planning system of claim 1, wherein the controller is configured to generate the flight risk profile for the future time period based upon the static information and the dynamic information.

11. The preflight planning system of claim 1, wherein the controller includes a route finder.

12. The preflight planning system of claim 11, wherein the route finder is configured to predict the flight route that has the low-risk.

13. The preflight planning system of claim 11, wherein the route finder predicts the low-risk of the flight route based upon a flight mission plan.

14. A non-transitory computer readable medium containing program instructions for causing a computer to perform a method of:

receiving data related to an aircraft type of unmanned aerial vehicle (UAV), wherein the data related to the aircraft type includes engine power data of the UAV, and the engine power data is data indicative of an engine power of the UAV;

receiving static information related to aspects of flight safety;

receiving dynamic information related to aspects of the flight safety;

generating a flight risk profile using the static information and a plurality of risk levels of airspace by assigning a numeral to each three-dimensional cubes that are arranged in stacks relative to each other, and each of the three-dimensional cubes represent areas of airspace, wherein the numeral assigned to each of the three-dimensional cubes indicate high-risk levels, moderate-risk levels, and low-risk levels based on the static information and the dynamic information at a future time period;

analyzing the risk levels of airspace using each numeral assigned to the respective three-dimensional cubes to determine a flight route that has a low-risk;

selecting the three-dimensional cubes, being the low-risk, as the flight route based on the flight risk profile; and operating the UAV to implement the selected flight route.

15. The non-transitory computer readable medium of claim 14, wherein the static information comprises data sets for a) regulations, b) airspace, c) ground obstacles, and d) infrastructure.

16. The non-transitory computer readable medium of claim 14, wherein the dynamic information comprises data sets for a) weather, b) air traffic, c) vehicular traffic, and d) UAV performance.

17. The non-transitory computer readable medium of claim 15, wherein the data sets comprise static information used to generate the risk levels of airspace of the flight risk profile.

18. The non-transitory computer readable medium of claim 16, wherein the data sets comprise dynamic information used to generate the risk levels of airspace of the flight risk profile.

19. A method of preflight planning with potential unmanned aerial vehicle (UAV) flight routes in a manner that quantitatively assesses and minimizes risks; the method comprising:

receiving, by a controller, data related to an aircraft type of an UAV, wherein the data related to the aircraft type includes engine power data of the UAV, and the engine power data is indicative of an engine power of the UAV;

receiving, by the controller, static information related to aspects of flight safety;

receiving, by the controller, dynamic information related to aspects of the flight safety;

generating, by the controller, at least one flight risk profile using the static information and a plurality of risk levels of airspace by assigning a numeral to each three-dimensional cubes that are arranged in stacks relative to each other, and each of the three-dimensional cubes represent areas of airspace, wherein the numeral assigned to each of the three-dimensional cubes indicate high-risk levels, moderate-risk levels, and low-risk levels based on the static information and the dynamic information at a future time period;

analyzing the risk levels of airspace using each numeral assigned to the respective three-dimensional cubes to determine a flight route that has a low-risk;

selecting the three-dimensional cubes, being the low-risk, as the flight route based on the at least one flight risk profile; and operating the UAV to implement the selected flight route.

20. The method of claim 19, further comprising:

wherein the controller is configured to determine the flight route using the at least one flight risk profile.

* * * * *